US011656037B2

(12) United States Patent
Tan

(10) Patent No.: US 11,656,037 B2
(45) Date of Patent: May 23, 2023

(54) SUPPORT ASSEMBLY FOR FINNED TUBE TYPE HEAT EXCHANGERS

(71) Applicant: Caterpillar Inc., Deerfield, IL (US)

(72) Inventor: Dongming Tan, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 16/414,815

(22) Filed: May 17, 2019

(65) Prior Publication Data

US 2020/0240723 A1 Jul. 30, 2020

Related U.S. Application Data

(63) Continuation-in-part of application No. 16/256,119, filed on Jan. 24, 2019, now Pat. No. 11,047,632.

(51) Int. Cl.
*F28F 9/00* (2006.01)
*F28F 9/013* (2006.01)

(52) U.S. Cl.
CPC ..... *F28F 9/0138* (2013.01); *F28F 2275/08* (2013.01)

(58) Field of Classification Search
CPC ..... F28F 2275/08; F28F 2275/085; F28F 2275/14; F28F 9/0138; B60Y 2410/113; F16I 3/1075; F16I 3/1083; F16I 3/23; F16I 3/2336
USPC ..... 24/265 EC
See application file for complete search history.

(56) References Cited

U.S. PATENT DOCUMENTS

| | | | | |
|---|---|---|---|---|
| 2,862,693 | A | 12/1958 | Tinker | |
| 3,934,645 | A | 1/1976 | Butts | |
| 4,570,704 | A | 2/1986 | Braun et al. | |
| 4,790,502 | A * | 12/1988 | Saegusa | F16L 3/123 24/20 R |
| 4,958,791 | A * | 9/1990 | Nakamura | F16L 3/23 248/74.1 |
| 6,935,599 | B2 * | 8/2005 | van Walraven | B29C 45/00 248/74.1 |
| 7,520,475 | B2 * | 4/2009 | Opperthauser | F16L 3/2431 248/71 |
| 7,784,745 | B2 | 8/2010 | Dodge | |
| 8,708,289 | B2 * | 4/2014 | Allenbach | F16L 3/2235 248/68.1 |
| 9,416,896 | B1 * | 8/2016 | Kato | F16L 3/222 |
| 9,714,798 | B2 | 7/2017 | Kinder et al. | |

(Continued)

FOREIGN PATENT DOCUMENTS

| | | | |
|---|---|---|---|
| DE | 3744644 | A1 | 7/1989 |
| DE | 102004024151 | A1 | 1/2005 |
| WO | 2018053584 | | 3/2018 |

*Primary Examiner* — Tho V Duong
(74) *Attorney, Agent, or Firm* — Bookoff McAndrews, PLLC

(57) ABSTRACT

A support assembly for attaching a heat exchanger to a frame of a machine. The support assembly includes a clip configured to at least partially surround a perimeter of a tube member of the heat exchanger. The clip includes a first end portion and a second end portion configured to engage the first end portion to hold the support assembly around the tube member in a closed position. The first end portion includes a laterally-extending projection and a laterally facing surface spaced apart from the projection by a recessed area. The second end portion defines a recess configured to receive a portion of the projection.

18 Claims, 7 Drawing Sheets

(56) References Cited

U.S. PATENT DOCUMENTS

| | | | | |
|---|---|---|---|---|
| 9,857,086 | B2 * | 1/2018 | Michiels | F16L 3/13 |
| 10,295,084 | B2 * | 5/2019 | Izawa | F16L 3/1075 |
| 2002/0135961 | A1 * | 9/2002 | Cheung | E04G 7/14<br>361/103 |
| 2008/0173773 | A1 | 7/2008 | Opperthauser | |
| 2009/0224111 | A1 * | 9/2009 | Gilbreath | F16L 3/222<br>248/68.1 |
| 2015/0184775 | A1 * | 7/2015 | Koski | F22B 37/205<br>248/68.1 |
| 2018/0224221 | A1 | 8/2018 | Kennedy et al. | |
| 2020/0064073 | A1 | 2/2020 | Tan et al. | |

* cited by examiner

SUPPORT ASSEMBLY FOR FINNED TUBE TYPE HEAT EXCHANGERS

CROSS-REFERENCE TO RELATED APPLICATIONS

This application is a continuation-in-part of U.S. patent application Ser. No. 16/256,119, filed Jan. 24, 2019, which is hereby incorporated by reference in its entirety as though fully set forth in the present application.

TECHNICAL FIELD

The present disclosure relates to a support assembly used to attach heat exchangers to the frame or chassis of a machine. Specifically, the present disclosure relates to a support assembly used to hold onto a finned tube type heat exchanger and attach the heat exchanger to the frame or chassis of earth moving, construction, and mining machine and the like.

BACKGROUND

Machines, such as those used in the earth moving, construction, and mining industries, use heat exchangers to cool engines or other heat producing devices. Support clips are often employed to attach the tube of a heat exchanger, such as a radiator, to a frame or chassis of the machine. The interface between the support clip and tube may experience play that may be caused by internal or external factors. Internal factors of this play may include erosion that occurs due to cavitation of the fluid flowing through the tube, leading to the tube wall deforming inwardly. External factors may include dimensional growth or contraction of the support clip due to changes in temperature or moisture or stack up tolerances.

Play between the support clip and the tube may lead to further issues with wear and/or an improper orientation of the heat exchanger relative to the flow of air meant to draw heat from the tube. In time, a hole may also develop in the tube, resulting in an undesirable loss of cooling fluid from the tube.

U.S. Pat. No. 2,862,693 to Tinker discloses a support clip for finned tubes in a finned tube heat exchanger. The clamping mechanism provided by the support clip is adjustable for ease of assembly and disassembly. A filler is provided between the fins that contacts the tube outer diameter and that is configured to contact an aperture of a frame member. However, as shown in FIGS. 1 thru 5 of Tinker, the disclosed apparatus in Tinker requires that two frame members are provided with apertures such that one aperture of one frame member provides support to the finned tube on only one side while the other aperture of the other frame member contacts the opposite side of the finned tube.

SUMMARY

A support assembly for attaching a heat exchanger to a frame of a machine, according to one aspect of the present disclosure, includes a clip configured to at least partially surround a perimeter of a tube member of the heat exchanger. The clip includes a first end portion and a second end portion configured to engage the first end portion to hold the support assembly around the tube member in a closed position. The first end portion includes a laterally-extending projection and a laterally facing surface spaced apart from the projection by a recessed area. The second end portion defines a recess configured to receive a portion of the projection.

A heat exchanger assembly for a machine having a frame, according to another aspect of the present disclosure, includes a tube member having an exterior surface and a support assembly attached to the frame and at least partially surrounding the tube member. The support assembly includes a first end portion having a laterally-extending projection and a laterally facing surface spaced apart from the projection by a recessed area, and a second end portion having a recess configured to receive a portion of the projection.

BRIEF DESCRIPTION OF THE DRAWINGS

The accompanying drawings, which are incorporated in and constitute a part of this specification, illustrate several embodiments of the disclosure and together with the description, serve to explain the principles of the disclosure. In the drawings.

DETAILED DESCRIPTION

Reference will now be made in detail to embodiments of the disclosure, examples of which are illustrated in the accompanying drawings. Wherever possible, the same reference numbers will be used throughout the drawings to refer to the same or like parts.

In some embodiments, a heat exchanger assembly that includes a heat exchanger and a clip that interfaces with a tube member of the heat exchanger to attach the heat exchanger to a frame of a machine may be provided. A support member may be disposed between the clip and the tube member to form a seal that prevents debris and other abrasive material from entering between the clip and the tube member.

Figure 2:
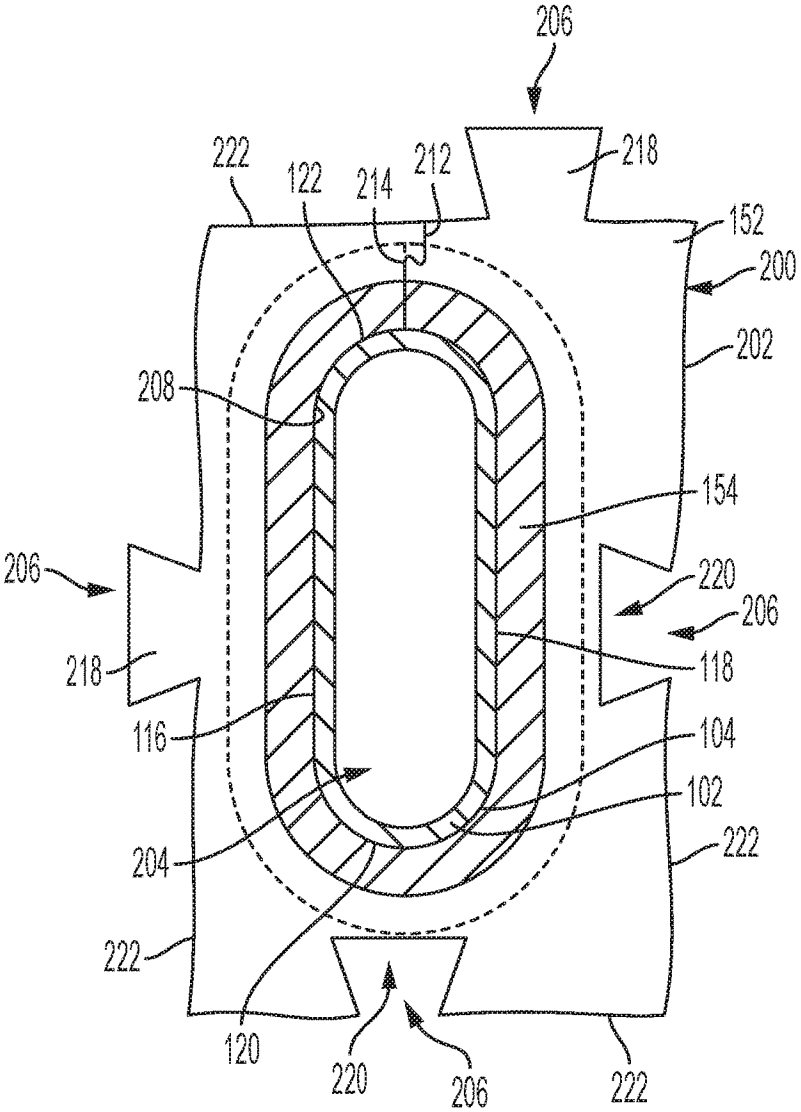
FIG. 2 is a sectional view of the finned tube and support assembly of FIG. 1.
Figure 1:
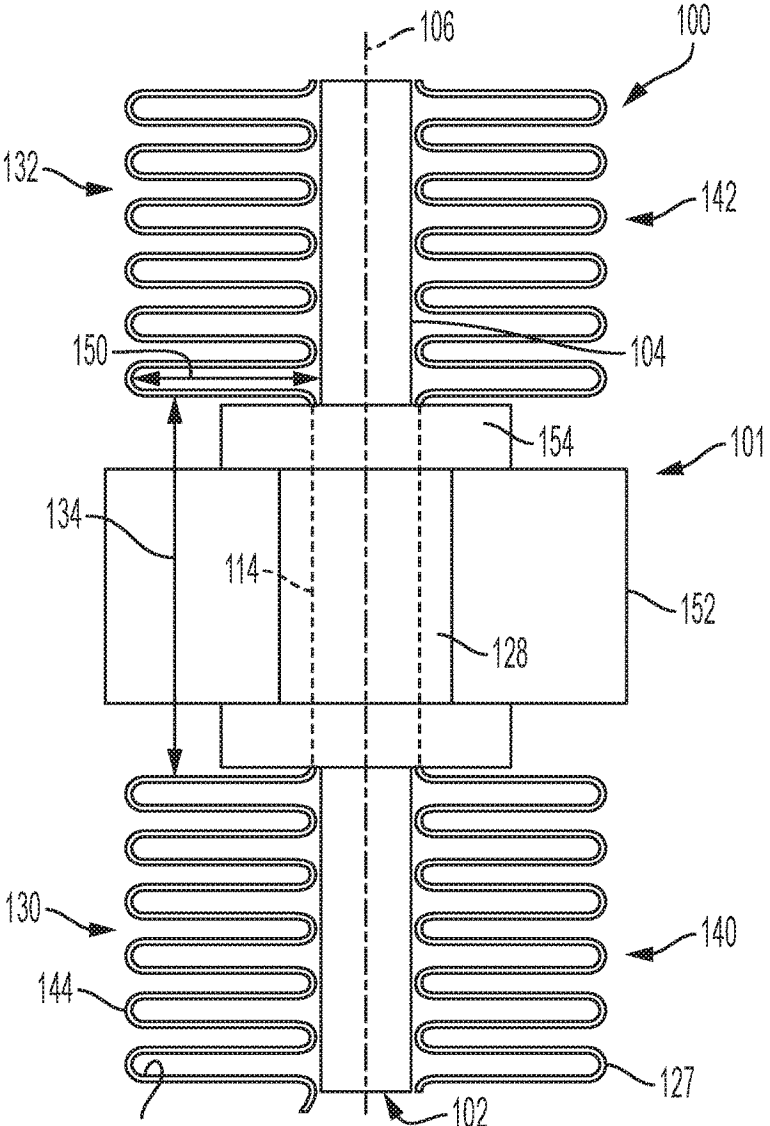
FIG. 1 is a front view of a heat exchanger assembly including a finned tube of a heat exchanger being supported by a support assembly according to an exemplary embodiment of the present disclosure.

FIGS. 1 and 2 illustrate an exemplary embodiment of a heat exchanger assembly 50 including a heat exchanger 100 and a support assembly 101 for attaching the heat exchanger 100 to the frame or chassis of a machine. The term "machine" may refer to any machine, such as a fixed or mobile machine, that performs some type of operation associated with an industry such as mining, construction, farming, transportation, or any other industry known in the art. For example, the machine may be an earth moving machine such as a track-type tractor, a motor grader, a backhoe, a loader, a material handler, or any other earth moving machine.

The heat exchanger 100 may include a tube member 102 having an exterior surface 104 and extending along a longitudinal axis 106. As best seen in FIG. 2, the tube member 102 may include an annular configuration including a first straight side 116, a second straight side 118 opposite the first straight side 116, a first arcuate portion 120 connecting the first straight side 116 to the second straight side 118, and a second arcuate portion 122 connecting the first straight side 116 to the second straight side 118. In the illustrated embodiment, the first straight side 116 is parallel to the second straight side 118 and the first arcuate portion 120 is disposed diametrically opposite of the second arcuate portion 122. Hence, the annular configuration may resemble an oval, oblong, or a "race track" shape. In other embodiments, however, the tube member 102 may be otherwise shaped.

The heat exchanger 100 may include a first undulating fin section 130 disposed adjacent the first straight side 116 of tube member 102, a second undulating fin section 132 disposed adjacent the first straight side 116 of the tube member 102 and being spaced away axially from the first undulating fin section 130, defining an axial gap 134. The first undulating fin section 130 may be connected to the second undulating fin section 132 by a straight section (not shown) extending along the first straight side 116 of the tube member 102, but that is optional.

The heat exchanger 100 may include a third undulating fin section 140 disposed adjacent the second straight side 118 of the tube member 102, a fourth undulating fin section 142 disposed adjacent the second straight side 118 of the tube member 102 and being spaced away axially from the third undulating fin section 140, also defining the axial gap 134. The third undulating fin section 140 may be connected to the fourth undulating fin section 142 by a straight section (not shown) extending along the second straight side 118 of the tube member 102, but that is optional.

Each of the undulating fin sections 130, 132, 140, 142 include one or more fin members 144 that include a heat transfer portion 146 extending from the exterior surface 118 of the tube member 102 along a direction 150 that is not parallel to the longitudinal axis 106. In some embodiments, any fin member 144 may have fins that spiral about the exterior surface 104 of the tube member 102 with an axis coincident with the longitudinal axis 106 in lieu of or in addition to the undulations. Also, only one fin member 144 may be provided in other embodiments and the annular configuration of the tube member 102 may have other shapes including rectangular, circular, etc. It is to be further understood that a plurality of tube members with fin members and cross-members that connect tube members together may be provided in various embodiments of the heat exchanger 100.

The tube member 102 and the undulating fin sections 130, 132, 140, 142 may be made from any suitable material or materials with suitably durable and thermal conductivity. In one exemplary embodiment, the tube member 102 and the undulating fin sections 130, 132, 140, 142 are made from aluminum or copper. In one exemplary embodiment, the tube member 102 and the undulating fin sections 130, 132, 140, 142 are made from the same material.

The undulating fin sections 130, 132, 140, 142 may be attached to the tube member 102. The undulating fin sections 130, 132, 140, 142 may be attached to the tube member 102 in any suitable manner. For example, in some embodiments, the undulating fin sections 130, 132, 140, 142 may be brazed to the tube member 102.

The support assembly 101 is disposed in the axial gap 134 and at least partially surrounds the exterior surface 104 of the tube member 102. The support assembly 101 includes a clip 152 and a support member 154. The clip 152 is configured to attach the heat exchanger 100 to the frame of a machine while the support member 154 is disposed between the clip 152 and the tube member 102.

Figure 3:
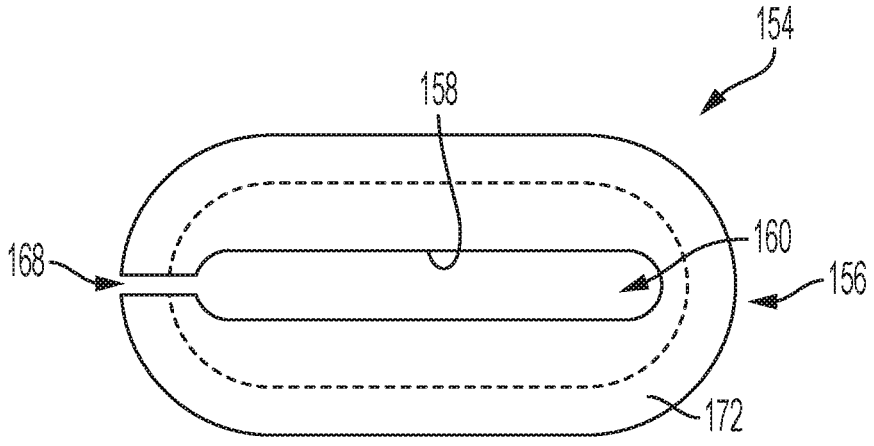
FIG. 3 is a top view of an exemplary embodiment of a support member of the support assembly of FIG. 2.
Figure 4:
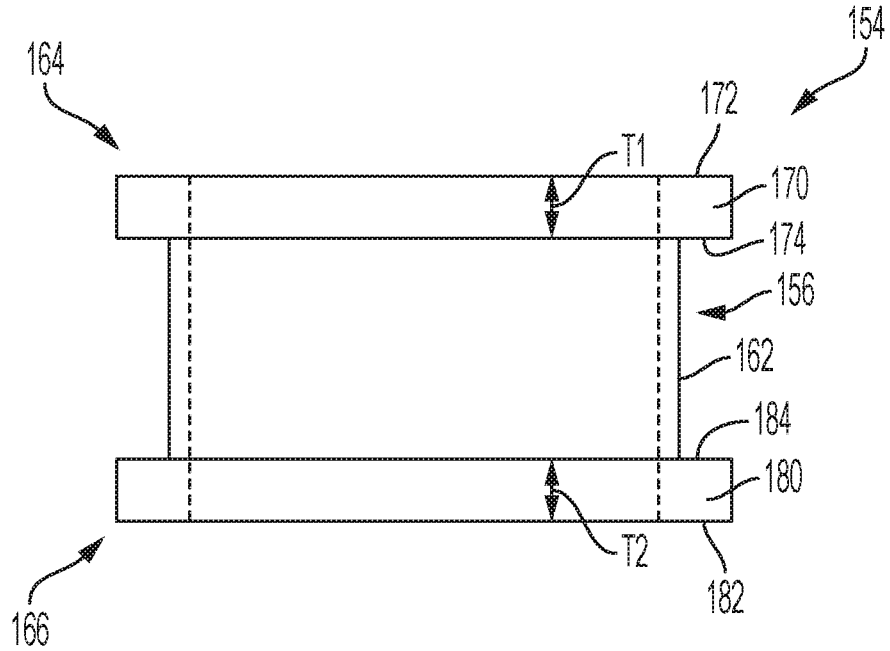
FIG. 4 is a side view of the support member of the support assembly of FIG. 2.

The support member 154 may be configured in a variety of ways. Any configuration that forms a snug fitting interface between the clip 152 and the tube member 102 may be used. Referring to FIGS. 2-4, in the illustrated embodiment, the support member 154 has a generally C-shaped body 156 having a height H, an interior surface 158 defining an aperture 160 and an exterior surface 162 generally parallel to the interior surface 158. In the illustrated embodiment, the aperture 160 is generally shaped similar to the exterior surface 104 of the tube member 102. The body 156 includes a first end portion 164 and a second end portion 166 opposite the first end portion 164 and a seam or channel 168 extending from the first end portion 164 to the second end portion 166.

The first end portion 164 defines a first flange 170 having a thickness T1, a first end face 172, and a first inward facing shoulder 174. The second end portion 166 defines a second flange 180 having a thickness T2, a second end face 182 opposite the first end face 172, and a second inward facing shoulder 184.

The support member 154 may be made of any suitable material capable of forming a seal between the clip 152 and the tube member 102 and withstanding the temperatures associated with operation of the heat exchanger 100. In an exemplary embodiment, the support member 154 is made of a compressible material, such as, for example, any suitable rubber.

Referring to FIG. 2, the clip 152 may comprise a body 200 defining an exterior profile 202, and an adjustably sized aperture 204 configured to receive the support member 154. The exterior profile 202 may define at least one attachment feature 206 and the body 200 may include an interior surface 208 defining the adjustably sized aperture 204.

In particular embodiments, the body 200 may define a living hinge 210 disposed adjacent the exterior profile 202 and forming a portion of the adjustably sized aperture 204. The body 200 may further define a seam 212 connecting the exterior profile 202 to the interior surface 208. The seam 212 may define an undercut 214 configured to keep the body 200 locked in a closed configuration to minimize the size of the adjustably sized aperture 204. Once locked, the interior surface 208 of the clip 152 engages the exterior surface 162 of the support member 154 such that the clip 152 may hug or compress the support member 154.

The at least one attachment feature 206 may take any suitable form including adhesive, fasteners, clips, threaded holes, etc. As shown in FIG. 2, the at least one attachment feature 206 may include at least one of the following: a tenon 218 and a mortise 220.

The exterior profile 202 may take any suitable shape. As shown in FIG. 2, the exterior profile 202 may include a quadrilateral shape with four sides 222. Any or each of the four sides 222 may include the at least one attachment feature 206.

The clip 152 may be made from any suitable material including plastic, metal, etc.

Figure 5:
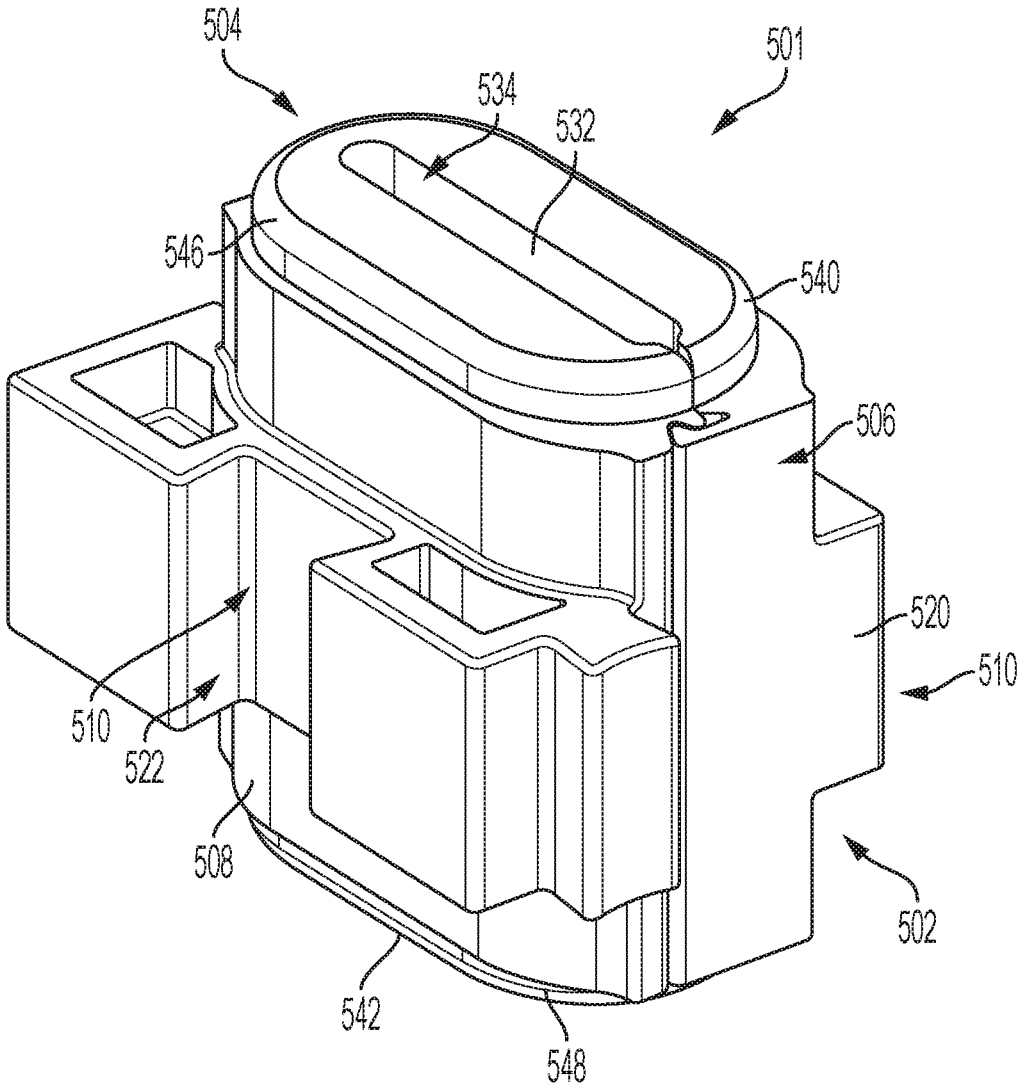
FIG. 5 is a perspective view of a support assembly according to another exemplary embodiment of the present disclosure.
Figure 6:
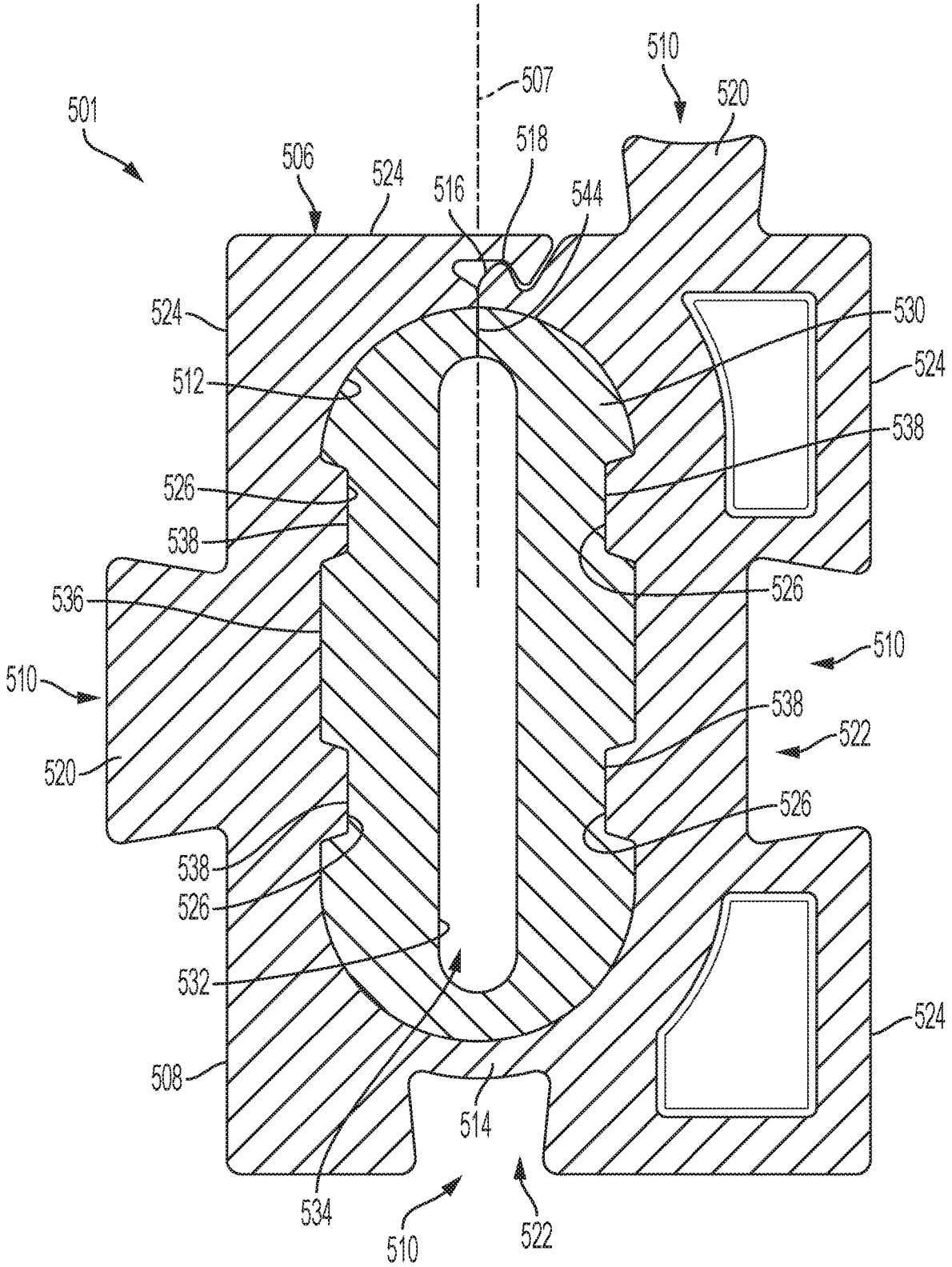
FIG. 6 is a sectional view of the support assembly of FIG. 5.

FIGS. 5-6 illustrate another exemplary embodiment of a support assembly 501 includes a clip 502 and a support member 504. The support assembly 501 of FIGS. 5-6 is similar to the support assembly 101 of FIGS. 1-4 including having the same features. In the support assembly 501, however, the support member 504 is integrally formed with a clip 502.

The clip 502 comprises a body 506 having a longitudinal axis 507 and defining an exterior profile 508 having at least one attachment feature 510 and an interior surface 512 configured to attach to or be formed integrally with the support member 504. The body 506 may define a living hinge 514 opposite a seam 516 connecting the exterior profile 508 to the interior surface 512. The seam 516 may be defined by an undercut securing arrangement 518 configured to keep the body 506 locked in a closed configuration.

The at least one attachment feature 510 may take any suitable form including adhesive, fasteners, clips, threaded holes, etc. As shown in FIGS. 5-6, the at least one attachment feature 510 may include at least one of the following: a tenon 520 and a mortise 522.

The exterior profile 508 may take any suitable shape. As shown in FIG. 6, the exterior profile 508 may include a quadrilateral shape with four sides 524. Any or each of the four sides 524 may include the at least one attachment feature 510. The interior surface 512 may include one or more attachment features 526 to aid in attaching to the support member 504. The one or more attachment features 526 may be configured in a variety of ways. In the illustrated embodiment, the one or more attachment features 526 include a plurality of inward extending projections.

The clip 502 may be made from any suitable material including plastic, metal, etc.

The support member 504 may be configured in a variety of ways. Any configuration that can be attached or formed onto the interior surface 512 of the clip 502 and forms a snug fitting interface to the tube member 102 may be used. In the illustrated embodiment, the support member 504 has a generally C-shaped body 530 having an interior surface 532 defining an aperture 534 and an exterior surface 536 generally parallel to the interior surface 532. The exterior surface 536 may include one or more attachment features 538 to aid in attaching to the interior surface 512 of the clip 502. The one or more attachment features 538 may be configured in a variety of ways. In the illustrated embodiment, the one or more attachment features 538 include a plurality of recesses for receiving the projections on the interior surface 512 of the clip 502.

In the illustrated embodiment, the aperture 534 is generally shaped similar to the exterior surface 104 of the tube member 102. The body 530 includes a first end portion 540 and a second end portion 542 opposite the first end portion 540 and a channel or seam 544 extending from the first end portion 540 to the second end portion 542. The first end portion 540 may define an optional first flange 546 and the second end portion 542 may define an optional second flange 548.

The support member 504 may be made of any suitable material capable of forming a seal with the tube member 102 and being formed with or attached to the interior surface 512 while withstanding the temperatures associated with operation of the heat exchanger 100. In an exemplary embodiment, the support member 504 is made of an elastic and compressible material, such as, for example, any suitable rubber.

The support member 504 may be attached to the interior surface 512 of the clip 502 in any suitable manner, such as molding onto, attached via adhesives, an interference or friction fit, fasteners, or other suitable forms of attachment.

Figure 7:
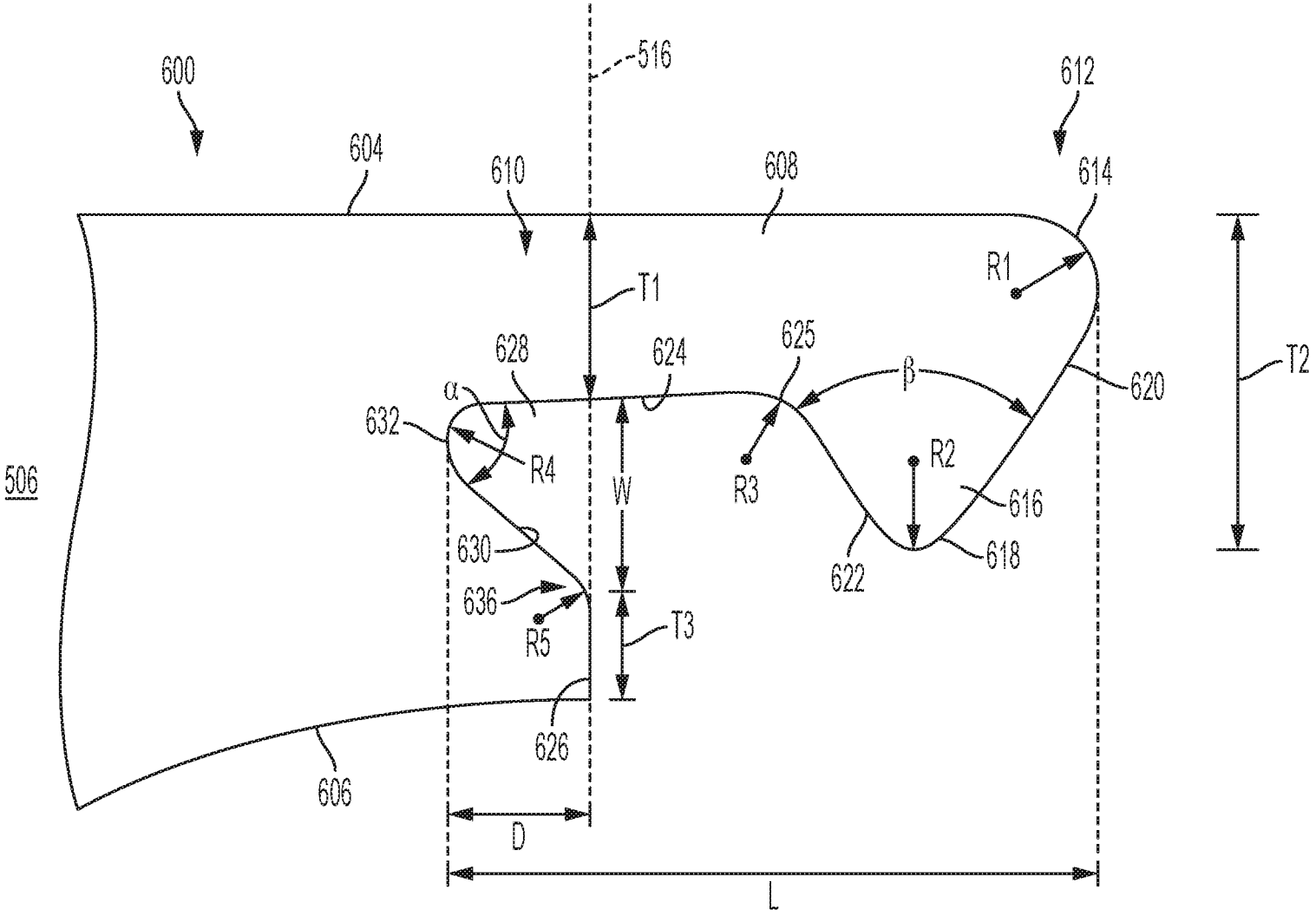
FIG. 7 is an enlarged view of an exemplary embodiment of a first portion of a securing arrangement of the support assembly of FIG. 5.
Figure 8:
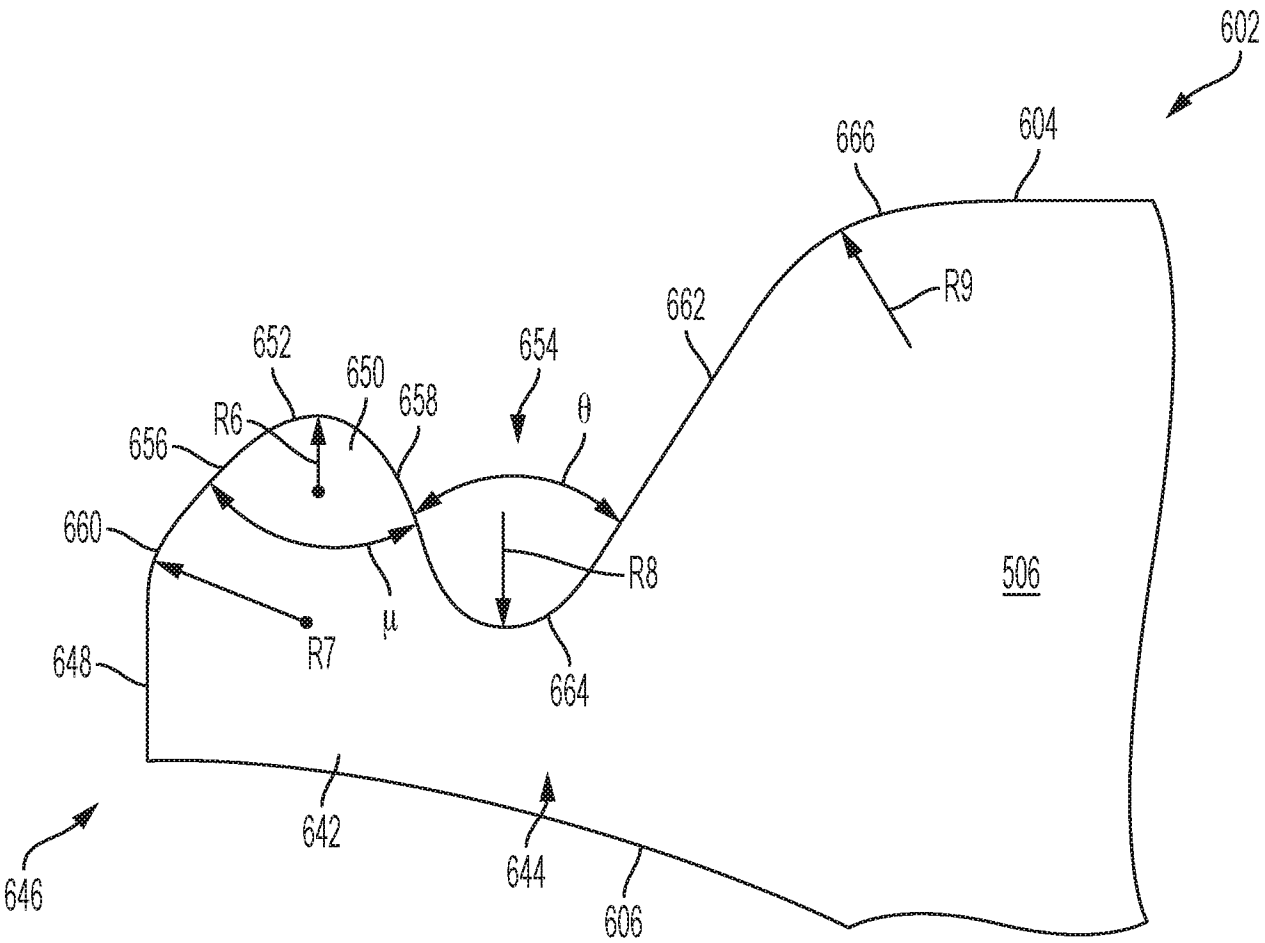
FIG. 8 is an enlarged view of an exemplary embodiment of a second portion of a securing arrangement of the support assembly of FIG. 5.

FIG. 7 illustrates an enlarged view of the securing arrangement 518 of the clip 502. The securing arrangement 518 is configured with a profile that provides generally uniform loading on the securing arrangement 518. The securing arrangement 518 may be configured in a variety of ways. The securing arrangement 518 may be defined by structure positioned at a first end portion 600 of the clip 502 and structure positioned at a second end portion 602 of the clip 502 that is configured to engage with the structure positioned at the first end portion 600 to hold the clip 502 in a closed position.

In the illustrated embodiment, the clip 502 includes an outer side 604 and an inner side 606. The first end portion 600 includes a finger-like outer projection 608 extending laterally along the outer side 604. The outer projection 608 includes a proximal end portion 610 where the outer projection 608 is integrally connected to the body 506 of the clip 502 and a distal end portion 612 opposite the proximal end portion 610. In the illustrated embodiment, the outer projection 608 tapers inward slightly from the proximal end portion 610 to the distal end portion 612. In other embodiments, however, the outer projection 608 may taper outward or may not be tapered.

The distal end portion 612 includes a distal tip 614 and an axially, inward extending protrusion 616 having a protrusion tip 618. In the illustrated embodiment, distal tip 614 is rounded having a radius R1. In some embodiments, the distal tip radius R1 may be in the range of 0.3 to 0.5 mm, or 0.4 mm.

The inward extending protrusion 616 may be configured in a variety of ways. In the illustrated embodiment, the protrusion 616 is formed by an outward surface 620 and an inward surface 622. The outward surface 620 and the inward surface 622 taper inward to the protrusion tip 618 such that the protrusion 616 resembles a triangle. In the illustrated embodiment, the outward surface 620 and the inward surface 622 generally form an angle β therebetween and the protrusion tip 618 may be rounded having a radius R2. In the illustrated embodiment, the angle β is in the range of 55 degrees to 65 degrees, or 60 degrees, and the radius R2 is in the range of 0.2 to 0.4 mm, or 0.3 mm.

The outer projection 608 includes an inner surface 624 connected to the inward surface 622 of the protrusion 616 by a corner 625 having a radius R3. In the illustrated embodiment, the radius R3 is in the range of 0.3 to 0.5 mm, or 0.4 mm.

The first end portion 600 includes an engagement surface 626 adjacent the inner side 606. In the illustrated embodiment, the engagement surface 626 is configured to engage a corresponding surface on the second end portion 602. The engagement surface 626 may be laterally facing and extend from the inner side 606 generally parallel to the longitudinal axis 507. In other embodiments, however, the engagement surface 626 may not extend parallel to the longitudinal axis 507 and may not be configured to contact the second end portion 602.

The first end portion 600 further includes a recessed area 628 between the outer projection 608 and the engagement surface 626. The recessed area 628 is an open space adjacent the outer projection 608 that is configured to allow the outer projection 608 to flex without undue stress when closing and maintaining the support assembly 501 in the closed position.

In the illustrated embodiment, the recessed area 628 is defined by the inner surface 624 of the outer projection 608, an angled surface 630, an inner corner 632 connecting the angled surface 630 to the inner surface 624 and having a radius R4, and an outer corner 636 having an outer radius R5 connecting the angled surface 630 to the engagement surface 626. The angled surface 630 extends at an angle α relative to the inner surface 624. In the illustrated embodiment, the angle α is in the range of 35 degrees to 45 degrees, or 40 degrees. In other embodiments, however, the angle α may be larger than 45 degrees or smaller than 35 degrees.

In the illustrated embodiment, the radius R4 and the radius R5 are in the range of 0.2-0.4, or 0.3. In other embodiments, however, either or both of the radius R4 and the radius R5 may be greater than 0.4 or less than 0.2. In the illustrated embodiment, the recessed area 628 resembles a triangular area between the outer projection 608 and the engagement surface 626. In other embodiments, however, the shape of the recessed area 628 may be other than resembling triangular.

As shown in FIG. 7, the recessed area 628 has a width W along the seam line 516 measured from the lower extent of radius R5 to the inner side 606 of the outer projection 608. The recessed area 628 also has a depth D measured perpendicular from the seam line 516 to the innermost portion of the radius R4. In some exemplary embodiments, the width W is greater than or equal to the depth D. In other embodiments, however, the width W may be less than the depth.

The outer projection 608 has a first thickness T1 measured along the seam line 516 from the outer side 604 to the inner surface 624. The outer projection 608 has a second thickness T2 at the protrusion tip 618 measured parallel to the seam line 516 from the outer side 604 to the outermost portion of the protrusion tip 618. In the illustrated embodiment, the second thickness T2 is greater than the first thickness T1. In some embodiments, the ratio of T2:T1 is in the range of 1.6:1 to 2.1:1, such as for example 1.8:1.

The outer projection 608 has a length L measured from the innermost portion of the radius R4 to the outermost portion of the distal tip 614. In some exemplary embodiments, the ratio of projection length L to recessed area depth D is in the range of 3.5:1 to 4.0:1.

The second end portion 602 includes an inner projection 642 extending laterally along the inner side 602. The inner projection 642 includes a proximal end portion 644 where the inner projection 642 is integrally connected to the body 506 of the clip 502 and a distal end portion 646 opposite the proximal end portion 644.

The distal end portion 646 includes an engagement surface 648, an axially, outward extending protrusion 650 having a protrusion tip 652, and an inward extending recess 654. In the illustrated embodiment, engagement surface 648 is configured to engage, or be adjacent, the engagement surface 626 of the first end portion 600 when the support assembly 504 is in a closed position. In some embodiments, the engagement surface 648 is arranged parallel with the engagement surface 626 of the first end portion 600 when the support assembly 504 is in a closed position.

The outward extending protrusion 650 may be configured in a variety of ways. In the illustrated embodiment, the outward extending protrusion 650 is formed by an outward surface 656 and an inward surface 658. The outward surface 656 and the inward surface 658 taper inward to the protrusion tip 652. In the illustrated embodiment, the outward surface 656 and the inward surface 658 generally form an angle μ therebetween and the protrusion tip 652 may be rounded having a radius R6. In the illustrated embodiment, the angle μ is in the range of 55 degrees to 65 degrees, or 60 degrees and the radius R2 is in the range of 0.3 to 0.5 mm, or 0.4 mm.

The engagement surface 648 is connected to the outward surface 656 of the protrusion 650 by a corner 660 having a radius R7. In the illustrated embodiment, the radius R7 is in the range of 0.7 to 0.9 mm, or 0.8 mm.

The recess 654 is defined by the inward surface 658, an angled surface 662, and an inner corner 664 connecting the inward surface 658 and the angled surface 662. In the illustrated embodiment, the angled surface 662 and the inward surface 658 generally form an angle θ therebetween and the protrusion tip 652 may be rounded having a radius R8. In the illustrated embodiment, the angle θ is in the range of 35 degrees to 45 degrees, or 40 degrees and the radius R8 is in the range of 0.3 to 0.5 mm, or 0.4 mm.

In the illustrated embodiment, the angled surface 662 is connected to the outer side 604 by a rounded corner 666 having a radius R9. In the illustrated embodiment, the radius R9 is in the range of 0.7 to 0.9, or 0.8.

INDUSTRIAL APPLICABILITY

The disclosed support assemblies 101, 201 may be used to support the heat exchanger 100 within an earth moving machine, such as, for example, a track-type tractor, a motor grader, a backhoe, a loader, a material handler, or any other earth moving machine. The clip and support member of the support assembly may wrap around the tube member of the heat exchanger and the clip may further attach to another portion of the machine, such as for example a frame portion, either directly or indirectly by connecting to another clip or other component.

In practice, the heat exchanger, the heat exchanger assembly, the support assembly, the clip, the support member, and/or the machine using any embodiment disclosed herein may be sold, bought, manufactured or otherwise obtained in an OEM (original equipment manufacturer) or after-market context. In some cases, various components, of the heat exchanger, of the heat exchanger assembly, of the machine, of the support assembly, etc. may be provided as a kit, etc.

Using the exemplary embodiment of FIGS. 1-4 as an example, in operation, the support assembly 101 may at least partially encompass a portion of the tube member 102 of a heat exchanger 100 to attach the heat exchanger to the frame of the machine. In particular, an exemplary embodiment of a method for supporting the heat exchanger 100 within the frame of a machine may include placing the support member 154 at least partially around the portion of the tube member 102 within the axial gap 134. In some embodiments, the support member 154 surrounds the entire perimeter of the portion of the tube member 102 in the axial gap 134.

Since the support member 154 may be made from an elastic material such as rubber, the support member 154 can be spread open to increase the size of the channel 168 such that the tube member 102 can slide through the channel 168 and be received within the aperture 160. Once released, the support member 154 wraps around the tube member 102. The aperture 160 may be sized to be slightly smaller than the perimeter of the exterior surface 118 of the tube member 102 such that the support member 154 is slightly compressed and forms a snug or tight fit around the exterior surface 118 of the tube member 102 to form a seal therebetween.

In the illustrated embodiment, the height H of the support member 154 may be the same as or slightly larger than the axial gap 134. Thus, the first end face 172 of the first flange 170 may abut one or both of the second and fourth undulating fin sections 132, 142 and the second end face 182 of the second flange 180 may abut one or both of the first and third undulating fin sections 130, 140. Therefore, the support member 154 may be slightly axially compressed and captured between the undulating fin sections 130, 132, 140, 142 such that the position of the support member 154 is fixed relative to the tube member 102.

In other embodiments, however, the support member 154 may have a height that is smaller than the axial gap 134 and is thus, not captured between the undulating fin sections 130, 132, 140, 142. For example, in at least one embodiment of the support assembly 501 in which the support member is attached to the interior surface of the clip, the height of the support member is less than the axial gap 134.

Once the support member 154 is on the tube member 102 such that the tube member 102 axially extends through the aperture 160, the clip 152 can be attached to the support member 154 and the tube member 102. To attach the clip 152 to the support member 154, the clip 152 can be opened via the living hinge 210 to enlarge the adjustably sized aperture 204. The opened clip 152 can be positioned adjacent to the support member 154 and closed onto the support member 154 between the first flange 170 and the second flange 180 such the interior surface 208 of the clip 152 engages the exterior surface 162 of the support member 154.

In the closed configuration, the undercut 214 can be engaged to lock the clip 152 in a closed configuration. Further, in the closed configuration, the adjustably sized aperture 204 of the clip 152 may be slightly smaller than the perimeter of the exterior surface 162 of the support member 154 such that the clip 152 may compress the support member 154 to form a snug fit and seal therebetween. The compression of the support member 154 may result in the channel 168 closing such that the support member 154 completely encompasses the tube member 102.

Further, in the closed position, the clip 152 is sandwiched between the first inward facing shoulder 174 and the second inward facing shoulder 184. Thus, the position of the support member 154 is fixed relative to the clip 152.

Once the clip 152 is secured onto the support member 154, the at least one attachment feature 206 may be used to attach the clip 152 to an adjacent clip having a complementary attachment feature or to the frame. Since any or each of the four sides 222 may include at least one attachment feature 206, the clip 152 may attach to adjacent clips or the frame on multiple sides 222

The support assembly 101, once installed, attaches the heat exchanger 100 to the frame of the machine. The support member 154 is captured between the undulating fin sections 130, 132, 140, 142 of the heat exchanger 100 and the clip 152 is captured between the first and second inward facing shoulders 174, 184 of the support member 154. Thus, the positions and orientations of the clip 152, the support member 154, and the tube member 102 of the heat exchanger 100 are fixed relative to each other. Further, the snug fit between the support member 154 and the tube member 102 provides a seal that prevents debris, such as dirt, sand or other abrasive material, and other material that could cause abrasive wear from entering between the support member 154 and the tube member 102

Figure 9:
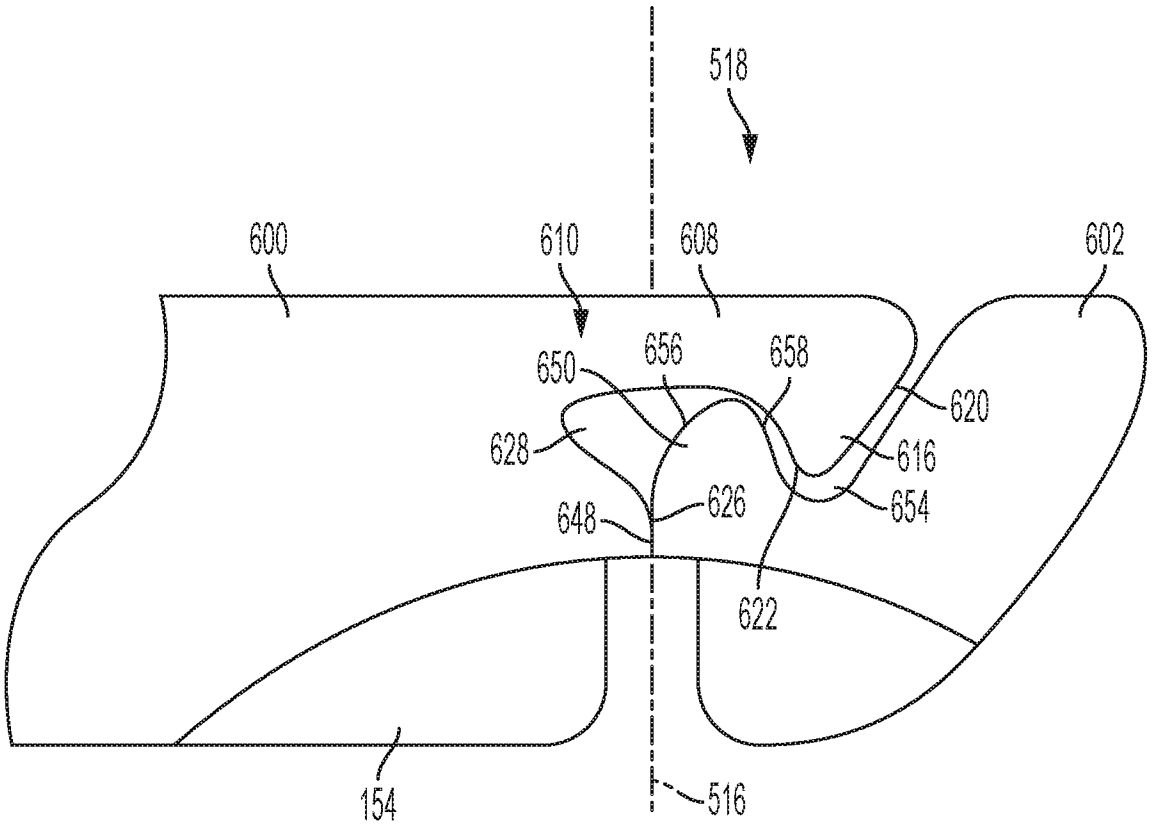
FIG. 9 is an enlarged view of the first portion and the second portion of the securing portion in a closed position.

FIG. 9 illustrates the securing arrangement 518 of the exemplary support arrangement of FIG. 6 in the closed configuration. Similar to the support member 154 and clip 152 described above, to attach the support assembly 501 to the tube member 102, the support assembly 501 can be opened via the living hinge 514 to enlarge the adjustably sized aperture 534. The opened support assembly 501 can be positioned to receive the tube member 102 within the aperture 534 and then closed around the tube member 102 such the interior surface 532 of the support member 504 engages the tube member 102.

When the support assembly 501 is being closed around the tube member 102, the outer projection 608 on the first end portion 600 flexes outward to allow the protrusion 616 on the outer projection 608 to pass the protrusion 650 on the second end portion 602. In particular, while the support assembly 501 is closing around the tube member 102, the outward surface 620 of the protrusion 616 on the first end portion 600 engages the outward surface 656 of the protrusion 650 on the second end portion 602. With enough closing force, the outward surface 620 of the protrusion 616 will slide along the outward surface 656 of the protrusion 650 causing the outer projection 608 to bend or flex outward. Due to the shape and size of the recessed area 628 of the first end portion 600, the moment arm of the outer projection 608 is larger and stress in the outer projection 608 is reduced as compared to a similar configuration without the disclosed recessed area 628.

Once the protrusion tip 618 on the first end portion 600 gets past the protrusion tip 652 on the second end portion 602, further closing of the support assembly 501 allows the outer projection 608 to return back toward an unflexed position as the outer projection 608 is received within the recess 654 on the second end portion 602. In the closed position, the engagement surface 626 may engage the engagement surface 648. Further, the inward surface 622 on the protrusion 616 of the first end portion 600 may engage the inward surface 658 on the protrusion 650 of the second end portion 602 to secure the support assembly 501 in the closed position and resist the support assembly 501 opening and releasing the tube member 102.

It will be apparent to those skilled in the art that various modifications and variations can be made to the embodiments of the apparatus and methods of assembly as discussed herein without departing from the scope or spirit of the invention(s). Other embodiments of this disclosure will be apparent to those skilled in the art from consideration of the specification and practice of the various embodiments disclosed herein. For example, some of the equipment may be constructed and function differently than what has been described herein and certain steps of any method may be omitted, performed in an order that is different than what has been specifically mentioned or in some cases performed simultaneously or in sub-steps. Furthermore, variations or modifications to certain aspects or features of various embodiments may be made to create further embodiments and features and aspects of various embodiments may be added to or substituted for other features or aspects of other embodiments in order to provide still further embodiments.

Accordingly, it is intended that the specification and examples be considered as exemplary only, with a true scope and spirit of the invention(s) being indicated by the following claims and their equivalents.

Element List

| Element Number | Element Name |
|---|---|
| 50 | heat exchanger assembly |
| 100 | heat exchanger |
| 101 | support assembly |
| 102 | tube member |
| 104 | exterior surface |
| 106 | longitudinal axis |
| 118 | exterior surface |
| 120 | first arcuate portion |

-continued

| Element List | |
|---|---|
| Element Number | Element Name |
| 122 | second arcuate portion |
| 130 | first undulating fin section |
| 132 | second undulating fin section |
| 134 | axial gap |
| 140 | third undulating fin section |
| 142 | fourth undulating fin section |
| 144 | fin members |
| 146 | heat exchanger portion |
| 150 | direction |
| 152 | clip |
| 154 | support member |
| 156 | c-shaped body |
| 158 | interior surface |
| 160 | aperture |
| 162 | exterior surface |
| 164 | first end portion |
| 166 | second end portion |
| 168 | channel |
| 170 | first flange |
| 172 | first end face |
| 174 | first inward facing shoulder |
| 180 | second flange |
| 182 | second end face |
| 184 | second inward facing shoulder |
| 200 | body |
| 201 | disclosed support assemblies |
| 202 | exterior profile |
| 204 | adjustably sized aperture |
| 206 | attachment feature |
| 208 | interior surface |
| 210 | living hinge |
| 212 | seam |
| 214 | undercut |
| 218 | tenon |
| 220 | mortise |
| 222 | sides |
| 501 | support assembly |
| 502 | clip |
| 504 | support member |
| 506 | body |
| 508 | exterior profile |
| 510 | attachment feature |
| 512 | interior surface |
| 514 | living hinge |
| 516 | seam |
| 518 | undercut securing arrangement |
| 520 | tenon |
| 522 | mortise |
| 524 | side |
| 526 | attachment features |
| 530 | c-shaped body |
| 532 | interior surface |
| 534 | aperture |
| 536 | exterior surface |
| 538 | attachment features |
| 540 | first end portion |
| 542 | second end portion |
| 544 | seam |
| 546 | first flange |
| 548 | second flange |
| 600 | first end portion |
| 602 | second end portion |
| 604 | outer side |
| 606 | inner side |
| 608 | outer projection |
| 610 | proximal end portion |
| 612 | distal end portion |
| 614 | distal tip |
| 616 | protrusion |
| 618 | protrusion tip |
| 620 | outward surface |
| 622 | inward surface |
| 624 | inner surface |
| 625 | corner |
| 626 | engagement surface |

-continued

| Element List | |
|---|---|
| Element Number | Element Name |
| 628 | recessed area |
| 630 | angled surface |
| 632 | inner corner |
| 636 | outer corner |
| 640 | line |
| 642 | inner projection |
| 644 | proximal end portion |
| 646 | distal end portion |
| 648 | engagement surface |
| 650 | protrusion |
| 652 | protrusion tip |
| 654 | recess |
| 656 | outward surface |
| 658 | inward surface |
| 660 | corner |
| 662 | angled surface |
| 664 | inner corner |
| 666 | rounded corner |

What is claimed is:

1. A support assembly for attaching a heat exchanger to a frame of a machine, the heat exchanger having a tube member, the support assembly comprising:

a clip having an inner perimeter that is configured to at least partially surround an outer perimeter of the tube member, the clip including a first end portion and a second end portion configured to engage the first end portion to hold the support assembly around the tube member in a closed position, the first end portion and the second end portion defining a seam line, and a lateral direction that is perpendicular to the seam line, wherein the first end portion includes a laterally-extending projection and a laterally facing surface spaced apart from the laterally-extending projection by a recessed area that, in combination with the first end portion, extends beyond the laterally facing surface in the lateral direction to form an undercut along a direction that is parallel to the seam line, the second end portion defines a recess configured to receive a portion of the laterally-extending projection such that the undercut is spaced away from the inner perimeter of the clip along the seam line, the laterally facing surface has a first width along the seam line and the recessed area has a second width along the seam line that is greater than the first width, the undercut remains empty after the first end portion is snapped into the second end portion, and the laterally facing surface of the first end portion contacts an engagement surface of the second end portion along the seam line and at a location that is closer to the inner perimeter of the clip than the laterally-extending projection of the first end portion.

2. The support assembly of claim 1, wherein the recessed area has a depth greater than the first width.

3. The support assembly of claim 1, wherein the recessed area is defined by an inner surface of the laterally-extending projection, an angled surface extending at an acute angle relative to the inner surface, and a rounded corner connecting the inner surface and the angled surface.

4. The support assembly of claim 3, wherein the angled surface extends at an angle in the range of 35 degrees to 45 degrees relative to the inner surface.

5. The support assembly of claim 3, wherein the rounded corner has a radius in the range of 0.2 mm to 0.4 mm.

6. The support assembly of claim 5, wherein the laterally-extending projection includes an axially-extending protrusion that is configured to be received in the recess of the second end portion.

7. The support assembly of claim 6, wherein the axially-extending protrusion is defined by an inward surface, an outward surface extending at an acute angle relative to the inward surface, and a rounded tip connecting the inward surface to the outward surface.

8. The support assembly of claim 7, wherein the inward surface extends at an angle in the range of 55 degrees to 65 degrees relative to the outward surface.

9. The support assembly of claim 7, wherein the rounded tip has a radius in the range of 0.2 mm to 0.4 mm.

10. The support assembly of claim 7, wherein the second end portion includes a second protrusion configured to engage the laterally-extending protrusion on the first end portion when the clip is in the closed position.

11. The support assembly of claim 10, wherein the second protrusion is defined by a second inward surface, a second outward surface extending at an acute angle relative to the second inward surface, and a second rounded tip connecting the second inward surface to the second outward surface.

12. The support assembly of claim 11, wherein the second inward surface extends at an angle in the range of 55 degrees to 65 degrees relative to the second outward surface.

13. The support assembly of claim 11, wherein the second rounded tip has a radius in the range of 0.3 mm to 0.5 mm.

14. A heat exchanger assembly for a machine having a frame, the heat exchanger assembly comprising:

a tube member having an exterior surface; and a support assembly attached to the frame, wherein the support assembly includes a clip having an inner perimeter that is configured to at least partially surround the exterior surface of the tube member, the clip including a first end portion and a second end portion configured to engage the first end portion to hold the support assembly around the tube member in a closed position, the first end portion and the second end portion defining a seam line, and a lateral direction that is perpendicular to the seam line, the first end portion including a laterally-extending projection and a laterally facing surface spaced apart from the laterally-extending projection by a recessed area that, in combination with the first end portion, extends beyond the laterally facing surface in the lateral direction to form an undercut along a direction that is parallel to the seam line, the second end portion defining a recess configured to receive a portion of the laterally-extending projection such that the undercut is spaced away from the inner perimeter of the clip along the seam line, the laterally facing surface having a first width along the seam line and the recessed area having a second width along the seam line that is greater than the first width, the undercut remaining empty after the first end portion is snapped into the second end portion, and the laterally facing surface is a stop surface being configured to contact an engagement surface of the second end portion along the seam line.

15. The heat exchanger assembly of claim 14, wherein the support assembly includes a rubber support member configured to create a seal against the tube member and the clip surrounding the support member.

16. The heat exchanger assembly of claim 14, wherein the recessed area has a depth greater than the first width.

17. The heat exchanger assembly of claim 14, wherein the laterally-extending projection includes an axially-extending protrusion that is configured to be received in the recess of the second end portion.

18. The heat exchanger assembly of claim 15, wherein the rubber support member is attached to an interior surface of the clip.

* * * * *